US011492895B2

(12) United States Patent
Kayode et al.

(10) Patent No.: US 11,492,895 B2
(45) Date of Patent: Nov. 8, 2022

(54) RELATIVE PERMEABILITY RATIO FROM WELLBORE DRILLING DATA

(71) Applicant: Saudi Arabian Oil Company, Dhahran (SA)

(72) Inventors: Babatope Kayode, Al-Khobar (SA); Bander Ghamdi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 70 days.

(21) Appl. No.: 16/661,586

(22) Filed: Oct. 23, 2019

(65) Prior Publication Data

US 2020/0149391 A1 May 14, 2020

Related U.S. Application Data

(60) Provisional application No. 62/760,596, filed on Nov. 13, 2018.

(51) Int. Cl.

| | |
|---|---|
| ***E21B 49/00*** | (2006.01) |
| ***E21B 47/10*** | (2012.01) |
| ***E21B 47/06*** | (2012.01) |
| ***E21B 47/003*** | (2012.01) |

(52) U.S. Cl.

CPC ..... *E21B 47/10* (2013.01); *E21B 47/003* (2020.05); *E21B 47/06* (2013.01); *E21B 49/008* (2013.01)

(58) Field of Classification Search

CPC ..... E21B 47/10; E21B 47/003; E21B 47/06; E21B 49/00; E21B 49/008; E21B 49/003; E21B 43/00; E21B 43/20; E21B 49/08; G06F 30/20; G06F 2111/10; G01V 99/005; G01V 11/00; G01V 2210/663;

(Continued)

(56) References Cited

U.S. PATENT DOCUMENTS 4,893,504 A * 1/1990 O'Meara, Jr. ..... G01N 15/08 378/68
6,860,147 B2 3/2005 Gunter et al.
7,565,278 B2 7/2009 Li et al.

(Continued)

FOREIGN PATENT DOCUMENTS

WO WO 2007076044 7/2007

OTHER PUBLICATIONS

Sheng, James J. Modern chemical enhanced oil recovery: theory and practice. Gulf Professional Publishing, 2010. (Year: 2010).*

(Continued)

*Primary Examiner* — Yoshihisa Ishizuka
*Assistant Examiner* — Carter W Ferrell
(74) *Attorney, Agent, or Firm* — Fish & Richardson P.C.

(57) ABSTRACT

Certain methods to determine wellbore relative permeability ratio from wellbore drilling data are described. A section of a wellbore is drilled in a subterranean zone including a subsurface reservoir in which hydrocarbons are entrapped. The hydrocarbons include a multiphase fluid including oil phase and water phase. A relevant suite of logs of rock in the section of the wellbore is determined. Water saturation is determined from the relevant suite of logs. A relative permeability ratio of the rock in the section to a flow of the oil phase and the water phase is determined. Using the relative permeability ratio, a flow rate of the oil phase or a flow rate of the water phase through the rock is determined.

29 Claims, 7 Drawing Sheets

(58) Field of Classification Search
CPC .. G01N 15/0826; G01N 24/081; G01N 15/08; G01N 15/082; G01N 22/04
See application file for complete search history.

(56) References Cited

U.S. PATENT DOCUMENTS

| | | | | |
|---|---|---|---|---|
| 9,140,117 | B2 | 9/2015 | de Prisco | |
| 2007/0203681 | A1* | 8/2007 | Eyvazzadeh | E21B 47/00 703/10 |
| 2011/0054796 | A1* | 3/2011 | Ikeda | E21B 49/081 702/12 |
| 2011/0168391 | A1* | 7/2011 | Saleri | G06Q 10/06 166/250.15 |
| 2014/0136116 | A1* | 5/2014 | Banian | G01N 15/082 702/12 |
| 2016/0305238 | A1* | 10/2016 | Gottumukkala | E21B 47/07 |
| 2017/0292377 | A1* | 10/2017 | Ramakrishnan | G01F 5/00 |

OTHER PUBLICATIONS

GCC Examination Report in Gulf Cooperation Council Appln. No. GC 2019-38631, dated Nov. 18, 2020, 5 pages.
International Search Report and Written Opinoin issued in International Application No. PCT/US2019/061125 dated Apr. 28, 2020, 16 pages.
Ahmed and McKinney, "Advanced Reservoir Engineering," Elsevier, 2005, 422 pages.
Ahmed, "Reservoir Engineering handbook," Elsevier, 2006, 1372 pages.
Fanchi, "Principles of Applied Reservoir Simulation, Third Edition," Elsevier, 2006, 530 pages.
Lu et al., "Experimental Investigation of the Live Oil-Water Relative Permeability and Displacement Efficiency on Kingfisher Waxy Oil Reservoir," Journal of Petroleum Sceince and Engineering, vol. 178, Apr. 11, 2019, 16 pages.
Alcocer, "A method for determination of Relative Permeability ratios using visual columns," SPE California Regional Meeting, Ventura, California, SP 20091-MS, Apr. 1990, 1 page.
Archie, "Introduction to Petrophysics of Reservoir Rocks," Bulletin of the American Association of Petroleum Geologists, vol. 34, No. 5, pp. 943-961, May 1950, 19 pages.
Archie, "Introduction to Petrophysics of Reservoir Rocks," Formula Only, May 1950, printed Oct. 16, 2019, 1 page.
Braun et al., "A steady State Technique for measuring oil-water relative permeability curves at reservoir conditions," Society of Petroleum Engineers of AIME, SPE 10155, Oct. 1981, 10 pages.
Honarpour et al., "Relative permeability measurement-an overview," SPE Technology Today, SPE 18565-PA, vol. 40, No. 8, pp. 963-966, Aug. 1988, 4 pages.
Loomis et al., "Calculation of relative permeabilites from displacements of their ratios," SPE California Regional Meeting, Pasadena, California, SPE 1611-G, Oct. 1960, 8 pages.
Odeh, "Effect of viscosity ratio on relative permeability," Society of Petroleum Engineers, SPE 1189-G, vol. 216, pp. 346-353, 1959, 8 pages.
Osoba et al., "Laboratory measurements of relative permeability," SPE 951047-G, vol. 3, No. 2, pp. 47-56, Feb. 1951, 10 pages.
GCC Examination Report in Gulf Cooperation Council Appln. No. GC 2019-38631, dated May 21, 2021, 4 pages.

* cited by examiner

| Sw | Krw | Kro |
|---|---|---|
| 0.2 | 0 | 0.8 |
| 0.25 | 0.002 | 0.61 |
| 0.3 | 0.009 | 0.47 |
| 0.35 | 0.02 | 0.37 |
| 0.4 | 0.033 | 0.285 |
| 0.45 | 0.051 | 0.22 |
| 0.5 | 0.075 | 0.163 |
| 0.55 | 0.1 | 0.12 |
| 0.6 | 0.132 | 0.081 |
| 0.65 | 0.17 | 0.05 |
| 0.7 | 0.208 | 0.027 |
| 0.75 | 0.251 | 0.01 |
| 0.8 | 0.3 | 0 |

FIG. 6

| Sw | Krw | Kro | dP psi | Qw bbls | Qo bbls | Krr |
|---|---|---|---|---|---|---|
| 0.2 | 0 | 0.8 | 500 | 0 | 0.757654 | 0 |
| 0.25 | 0.002 | 0.61 | 500 | 0.024624 | 0.577711 | 0.003279 |
| 0.3 | 0.009 | 0.47 | 500 | 0.110807 | 0.445122 | 0.019149 |
| 0.35 | 0.02 | 0.37 | 500 | 0.246238 | 0.350415 | 0.054054 |
| 0.4 | 0.033 | 0.285 | 500 | 0.406292 | 0.269914 | 0.115789 |
| 0.45 | 0.051 | 0.22 | 500 | 0.627906 | 0.208355 | 0.231818 |
| 0.5 | 0.075 | 0.163 | 500 | 0.923391 | 0.154372 | 0.460123 |
| 0.55 | 0.1 | 0.12 | 500 | 1.231188 | 0.113648 | 0.833333 |
| 0.6 | 0.132 | 0.081 | 500 | 1.625169 | 0.076713 | 1.62963 |
| 0.65 | 0.17 | 0.05 | 500 | 2.09302 | 0.047353 | 3.4 |
| 0.7 | 0.208 | 0.027 | 500 | 2.560872 | 0.025571 | 7.703704 |
| 0.75 | 0.251 | 0.01 | 500 | 3.090283 | 0.009471 | 25.1 |
| 0.8 | 0.3 | 0 | 500 | 3.693565 | 0 | |

FIG. 7

| Sw= 0.2 | | | Sw= 0.3 | | | Sw= 0.4 | | | Sw= 0.5 | | | Sw= 0.6 | | | Sw= 0.7 | | | Sw= 0.8 | |
|---|---|---|---|---|---|---|---|---|---|---|---|---|---|---|---|---|---|---|---|
| ΔP | qt | | ΔP | qt | | ΔP | qt | | ΔP | qt | | ΔP | qt | | ΔP | qt | | ΔP | qt |
| 100 | 0.151531 | | **100** | 0.111186 | | 100 | 0.135241 | | 100 | 0.215553 | | 100 | 0.340376 | | 100 | 0.517289 | | 100 | 0.738713 |
| **200** | 0.303062 | | 200 | 0.222372 | | 200 | 0.270463 | | 200 | 0.431105 | | 200 | 0.680752 | | 200 | 1.034577 | | **200** | 1.477426 |
| 300 | 0.454593 | | 300 | 0.333557 | | 300 | 0.405724 | | 300 | 0.646658 | | 300 | 1.021129 | | 300 | 1.551866 | | 300 | 2.216139 |
| **400** | 0.606124 | | 400 | **0.444743** | | **400** | 0.540965 | | **400** | 0.862211 | | **400** | 1.361305 | | **400** | 2.069154 | | **400** | 2.954852 |
| 500 | 0.737684 | | **500** | 0.555929 | | 500 | 0.476207 | | 500 | 1.077763 | | 500 | 1.701861 | | 500 | 2.546443 | | 500 | 3.893565 |

FIG. 11
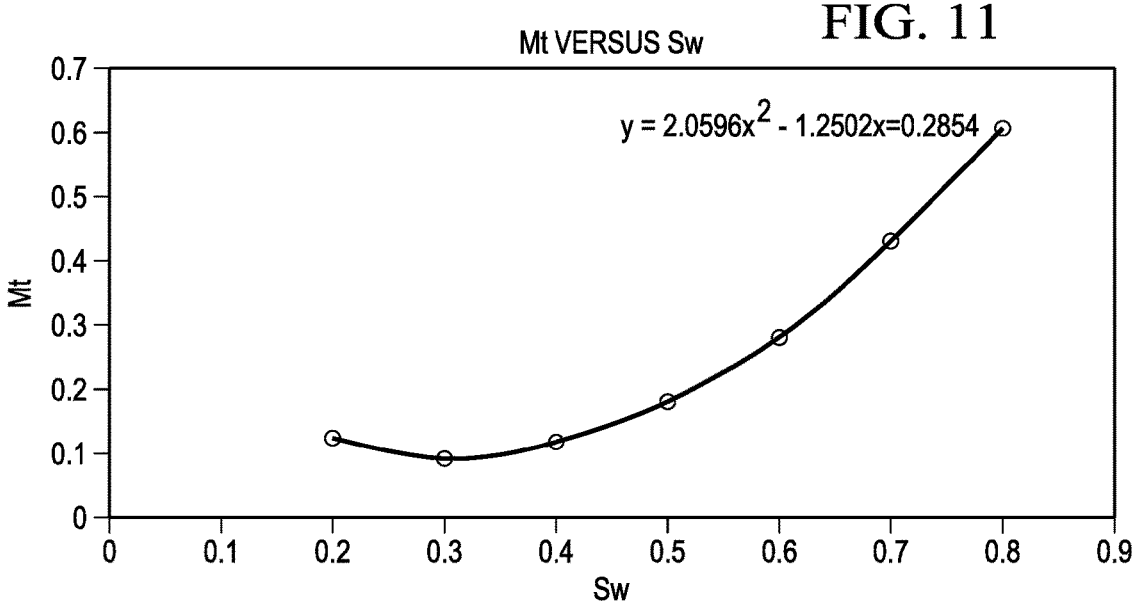
FIG. 12
| Sw | Krr | Mt | qo | qw | qt | MEASURED |
|---|---|---|---|---|---|---|
| 0.6 | 1.62963 | 0.276156 | 0.076628 | 1.623373 | 1.7000003 | 1.701881206 |
| 0.5 | 0.460123 | 0.178689 | 0.157557 | 0.942443 | 1.1000000 | 1.07776339 |
| 0.4 | 0.115789 | 0.113711 | 0.279412 | 0.420588 | 0.7000000 | 0.676206556 |
| 0.7 | 7.703704 | 0.422356 | 0.025705 | 2.574295 | 2.6000000 | 2.586442724 |
FIG. 13
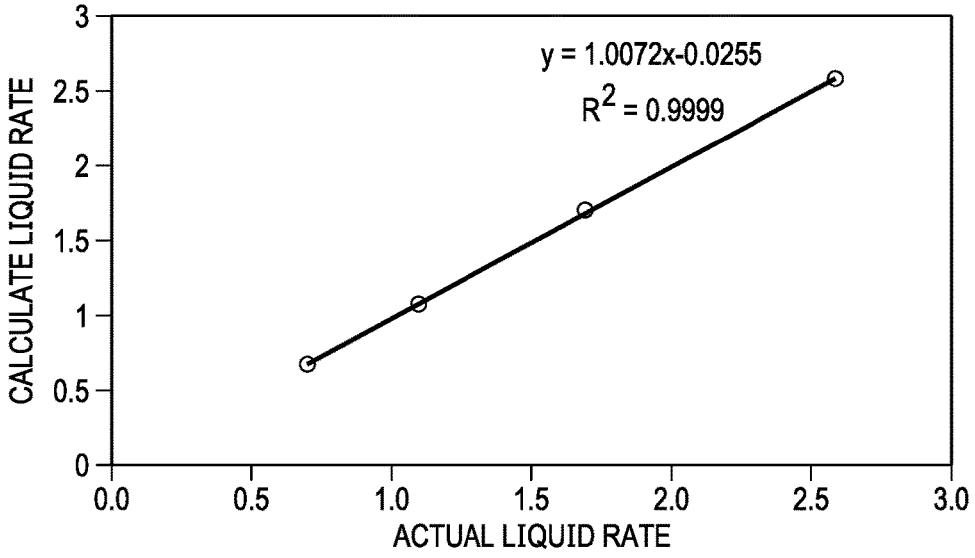

RELATIVE PERMEABILITY RATIO FROM WELLBORE DRILLING DATA

CLAIM OF PRIORITY

This application claims priority to U.S. Provisional Patent Application Ser. No. 62/760,596, filed on Nov. 13, 2018, the entire contents of which are hereby incorporated by reference.

TECHNICAL FIELD

The present disclosure relates to operations performed in hydrocarbon-carrying reservoirs, for example, drilling operations, and more particularly to obtaining information about the reservoirs from data obtained from drilling operations.

BACKGROUND

Hydrocarbons (for example, petroleum, natural gas, or combinations of them) entrapped in subsurface reservoirs of subterranean zones can be produced to the surface through wellbores. A wellbore can be drilled into the subterranean zone (for example, a formation, a portion of a formation, or multiple formations) from a surface to a desired depth and in desired orientations (for example, vertical, horizontal, angular, or combinations of them). The hydrocarbons are entrapped in the reservoirs under pressure. When the well is completed, the reservoir pressure forces the hydrocarbons into the wellbore, and the hydrocarbons are lifted to the surface.

The subsurface reservoirs define a porous network through which the hydrocarbons flow. Information about the porous network and other features of the subsurface reservoirs can improve well operations including drilling and production.

SUMMARY

The present disclosure describes methods and systems, including computer-implemented methods, computer program products, and computer systems for obtaining relative permeability ratio from wellbore drilling data.

Certain aspects of the subject matter described here can be implemented as a method. A section of a wellbore is drilled in a subterranean zone including a subsurface reservoir in which hydrocarbons are entrapped. The hydrocarbons include a multiphase fluid including oil phase and water phase. A relevant suite of logs of rock in the section of the wellbore is determined. Water saturation is determined from the relevant suite of logs. A relative permeability ratio of the rock in the section to a flow of the oil phase and the water phase is determined. Using the relative permeability ratio, a flow rate of the oil phase or a flow rate of the water phase through the rock is determined.

Aspects combinable with other aspects described here can include the following features. To determine the relative permeability ratio, a flow rate of the oil phase through the section of the wellbore is measured. A flow rate of the water phase through the section of the wellbore is measured. A formation volume factor and a viscosity for each of the oil phase and the water phase are determined from pressure, volume and temperature of the oil phase and the water phase.

Aspects combinable with other aspects described here can include the following features. To determine the relative permeability ratio, a drawdown pressure is imposed over a pre-determined depth interval through the section of the wellbore. A stabilized well fluid flow rate through the section of the wellbore at the drawdown pressure over the pre-determined depth interval is recorded.

Aspects combinable with other aspects described here can include the following features. The drawdown pressure is a first drawdown pressure. To determine the relative permeability ratio, multiple drawdown pressures are imposed over the pre-determined depth interval through the section of the wellbore. Each drawdown pressure is greater than the first drawdown pressure. For each drawdown pressure, a respective stabilized well fluid flow rate through the section of the wellbore at the drawdown pressure over the pre-determined depth interval is recorded.

Aspects combinable with other aspects described here can include the following features. To determine the relative permeability ratio, a water saturation and a total mobility of the liquid phase through the rock in the section is determined using Eq. 11 (described below) where R is determined from the slope of FIG. 10 (described below) for the corresponding water saturation.

Aspects combinable with other aspects described here can include the following features. A plot of the relative permeability ratio versus water saturation and the total mobility of the water phase for the multiple drawdown pressures and the first drawdown pressure is generated.

Aspects combinable with other aspects described here can include the following features. The aspects can be implemented entirely or in part as computer-implemented methods. The computer-implemented methods can be implemented as computer-readable media (for example, non-transitory computer-readable media) storing instructions executable by one or more processors. The computer-implemented methods can be implemented using a computer system including one or more processors that can execute such computer instructions stored on such a computer-readable medium.

DESCRIPTION OF DRAWINGS

FIG. 6 is a table showing an open source experimental Kr data and corresponding rock and fluid properties were used to generate measured oil and water rates at various saturations.

FIG. 7 is a table summarizing computed flow rates used to represent actual measured flow rates.

FIG. 11 is a plot of total mobility versus water saturation.

FIG. 12 is a table showing flow rates predictively determined from the total mobility and relative permeability ratio.

FIG. 13 is a plot showing the correlation between calculated rate and measured rate.

Like reference numbers and designations in the various drawings indicate like elements.

DETAILED DESCRIPTION

Figure 1:
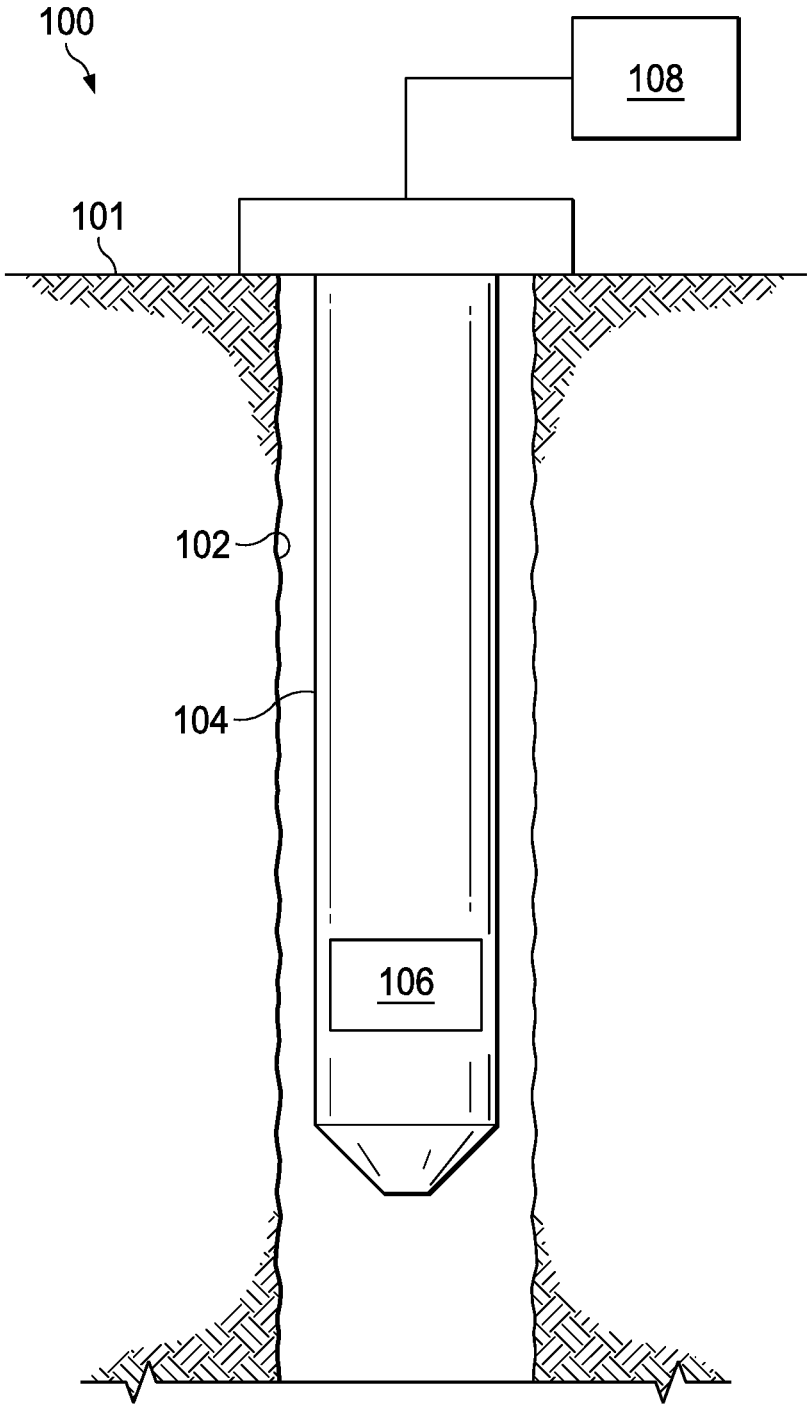
FIG. 1 is a schematic diagram of a wellbore being drilled in a subterranean zone.

Well resistivity logging is a method of characterizing the relative amounts of fluid types within a rock or sediment in a wellbore by measuring an electrical resistivity of the rock or sediment. The resistivity log correlates the resistivity of a rock at a depth in the wellbore to that depth and is a function of the relative amounts of fluid types present in the pores of the rock. Resistivity of a rock represents the rock's strength to oppose the flow of electric current. The rock on a subsurface hydrocarbon reservoir can carry multiphase fluids, for example, liquid petroleum, liquid water, natural gas, other fluid components, or combinations of them. The water can include dissolved salts which make the water highly conductive. Thus, the resistivity of water in the wellbore can be low. Conversely, liquid petroleum, being a dielectric fluid, can have high resistivity and low conductivity. The natural gas can have higher resistivity compared to liquid water.

Well resistivity logging can be implemented while drilling the wellbore. In some implementations, the logging equipment can be included in the drilling assembly that drills the wellbore such that resistivity logs are taken while the wellbore is being drilled. The output of resistivity logging can be used to determine, among other things, water saturation and hydrocarbon saturation (or oil saturation) of rock in the wellbore. Water saturation is a fraction or percentage of the pore volume filled with liquid water. Oil saturation is a fraction or percentage of the pore volume filled with liquid hydrocarbons. It is the output of density log that can be used to determine porosity of the rock Porous media are characterized by a permeability, which is a property of a material to allow fluids to pass through. Flow through porous media, such as the rock in the subsurface reservoirs, is modeled using Darcy's flow equations. Darcy's flow equations include an absolute permeability term (K) to account for the permeability of the porous media itself. When only a single fluid phase exists in the porous medium, effective permeability of medium to that phase is the same as the absolute permeability of the media regardless of the fluid type. But, when porous media contains multiple fluids, the displacement of each phase is impeded by the presence of other phases and hence the effective permeability to a particular phase in the presence of other phase(s) is lower than the absolute medium permeability and is a function of the particular phase saturation. Darcy's flow equations therefore include a relative permeability term ($K_r$) to account for multiphase flow. The relative permeability term ($K_r$) is measured through steady state or unsteady state laboratory experiments. The relative permeability term is fluid type and saturation dependent, that is, oil and water have respective relative permeability terms which are denoted by $K_{ro}$ and $K_{rw}$, respectively and are a function of the individual fluid saturations. The ratio of relative permeabilities of the porous media to two different types of fluids is called the relative permeability ratio. For example, the relative permeability ratio of water to oil ($K_{rr}$) is determined as $K_{rw}/K_{ro}$.

In certain approaches, the relative permeability ratio is determined by separately determining the relative permeability ratio of water ($K_{rw}$) and the relative permeability ratio of oil ($K_{ro}$). This disclosure describes methods, for example, computer-implemented methods, to determine a relative permeability ratio ($K_{rr}$) directly from wellbore drilling data, in particular, without needing to separately determine $K_{ro}$ and $K_{rw}$. This disclosure assumes an oil-water system with no gaseous or other phases. In some implementations, $K_{rr}$ can be determined directly by modifying flow equations, including Darcy's flow equations, as described below, to model flow through the subsurface reservoir rock and to predictively determine an expected flowrate of hydrocarbons through the wellbore.

FIG. 1 is a schematic diagram of a wellbore being drilled in a subterranean zone. FIG. 1 shows a drilling environment in which a subterranean zone 101 is being drilled, for example, using drilling tools 104, to form a wellbore 102 to access a subsurface reservoir in the subterranean zone 101 in which hydrocarbons are entrapped. In the following paragraphs, an example of a wellbore drilling system and operations implemented by the wellbore drilling system to drill a wellbore, for example, the wellbore 102, are described.

In wellbore drilling situations that use a drilling rig, a drilling fluid circulation system circulates (or pumps) drilling fluid (for example, drilling mud) with one or more mud pumps. The drilling fluid circulation system moves drilling mud (fluid, F) down into the wellbore 102 through special pipe referred to in the art as drill pipe (for example, the drilling tools 104), and drill collars which are connected to the drill sting. The fluid exits through ports (jets) in the drill bit, picking up cuttings C and carrying the cuttings up the annulus of the wellbore 104. The mud pump takes suction from mud tanks and pumps mud F out discharge piping, up the stand pipe, through rotary hoses, through Kelly or top drive unit, and into a central bore of the drill pipe, drill collars, and bit. Mud F and cuttings C return to the surface up annulus. At the surface, the mud and cuttings leave the wellbore through an outlet, and are sent to a cuttings removal system via mud return line. At the end of the return lines, mud F and cutting C are flowed onto a vibrating screen known in the art as a Shale Shaker. Finer solids may be removed by a sand trap. The mud may be treated with chemicals stored in a chemical tank and then provided into the mud tank, where the process is repeated.

The drilling fluid circulation system delivers large volumes of mud flow under pressure for drilling rig operations. The circulation system delivers the mud to the drill stem to flow down the string of drill pipe and out through the drill bit appended to the lower end of the drill stem. In addition to cooling the drill bit, the mud hydraulically washes away the face of the wellbore through a set of openings in the drill bit. The mud additionally washes away debris, rock chips, and cuttings, which are generated as the drill bit advances. The circulation system flows the mud in an annular space on the outside of the drill stem and on the interior of the open hole formed by the drilling process. In this manner, the circulation system flows the mud through the drill bit and out of the wellbore.

The mud flows through the drill stem and the annular space at a sufficient velocity to move debris, chips and cuttings, which are heavier than the mud, to the surface. The velocity of the mud should also be sufficient to cool the drill bit. The wellhead pressures at the pump are sufficiently high to flow the mud at the desired velocity and also to overcome substantial flow pressure resistance along the flow path. In some situations, the circulation system can flow the mud through the drill bit and the wellbore at high volumetric flow rates (for example, 500 to 1,000 gallons per minute) and at pressures as high as 5,000 PSI. The circumstances under which the drilling rig is used can cause the drill string to experience a pack off, for example, when the cuttings or debris (or both) clog the flow path of the drilling mud in the annulus between the borehole and the drill string, drill collars, or drill bit, or combinations of them. Consequently, a downhole pressure can rapidly increase resulting in fracture of one or more downhole formations and possibly even loss of the wellbore.

The drilling system can include logging equipment 106 to measure resistivity of rock in a section of the wellbore, as described above. In some implementations, the logging equipment 106 can be included with other tools in the drilling assembly. The drilling system can be connected to a computer system 108. In particular, the logging equipment 106 can be connected to the computer system 108 to receive instructions and to transmit data, for example, resistivity data, to the computer system. In response to receiving the resistivity data, the computer system 108 can implement methods described in this disclosure.

Figure 2:
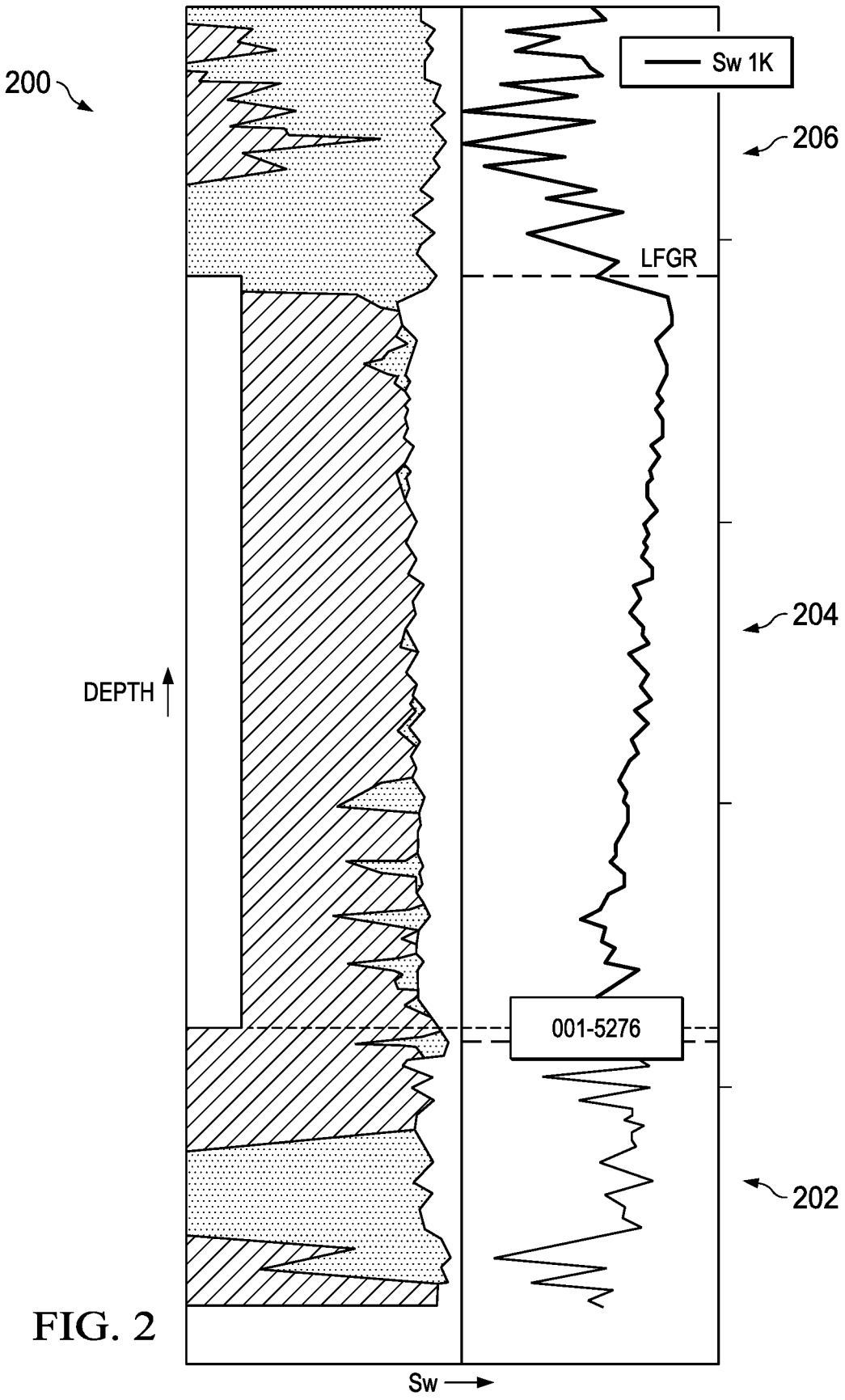
FIG. 2 is an example of a relevant suite of logs of a section of the wellbore.

FIG. 2 is an example of a resistivity log 200 of a section of the wellbore. The log 200 shows water saturation of a fluid phase (X-axis) at different depths (Y-axis) in the section of the wellbore. In some implementations, after drilling the section of the wellbore, the logging equipment 106 can be lowered through the section to measure the resistivity of the rock in the section. Using techniques described later, the resistivity of the rock at the different depths can be used to determine the saturation of the fluid phase. The log 200 identifies three zones (that is, zones 202, 204, 206), each having rock of substantially the same water saturation.

Figure 3:
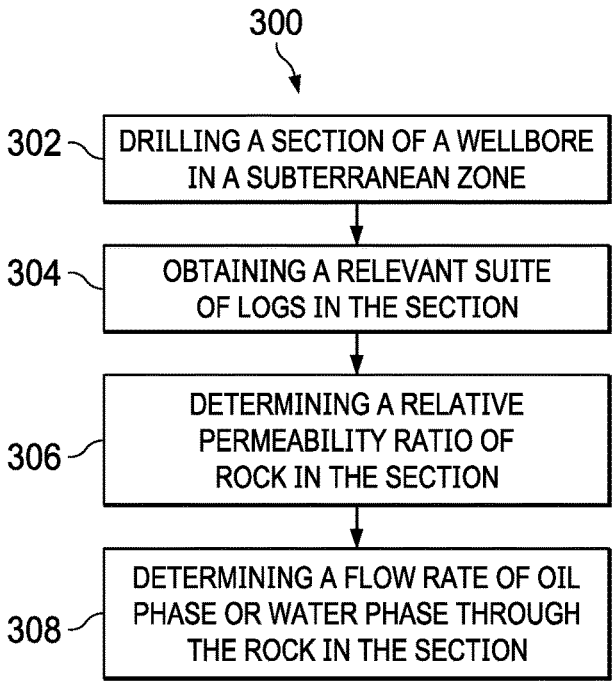
FIG. 3 is a flowchart of an example of a process to predictively determine flow rate of a phase of fluid.

FIG. 3 is a flowchart of an example of a process 300 to predictively determine flow rate of a phase of fluid. Certain process steps of the process 300 can be implemented manually while other process steps can be implemented by a computer system, for example, the computer system 500 described with reference to FIG. 5. At 302, a section of a wellbore is drilled in a subterranean zone. The subterranean zone includes a subsurface reservoir in which hydrocarbons are entrapped. The hydrocarbons include a multiphase fluid including an oil phase and a water phase. The section of the wellbore can be drilled using drilling techniques described earlier.

At 304, a relevant suite of logs of the rock in the section of the wellbore is obtained. The relevant suite of logs including, for example, the resistivity log 200, can be obtained using techniques described earlier. The relevant suite of logs also include the density logs. Together, the resistivity logs and the density logs are used in Archie's equation to calculate water saturation. For example, water saturation can be calculated using Eqs. 1.i-1.iv.

$$Sw = \sqrt{\frac{R_w}{(\phi^2 R_t)}} \quad \text{Eq. 1.i}$$

$$R_t = R_o S_w^{-2} \quad \text{Eq. 1.ii}$$

$$R_o = F R_w \quad \text{Eq. 1.iii}$$

$$F = \varphi^{-2} \quad \text{Eq. 1.iv}$$

In Eqs. 1.i-1.iv, $S_w$ is water saturation (fraction), $R_w$ is resistivity of formation brine, φ is formation porosity (fraction) and $R_t$ is resistivity of hydrocarbon bearing formation.

The relevant suite of logs can be interpreted for water saturation ($s_w$). Zones of constant water saturation (for example, zones 202, 204, 206) are then tested, and the relative amounts of oil and water flow are measured.

At 306, a relative permeability ratio of rock in the section is determined. For example, by computationally solving equations described later, the flow data are converted to a plot of relative permeability ratio as a function of average water saturation ($K_{rr(sw)}$) and saturation dependent total mobility ($M_{t(sw)}$). In particular, $K_{rr(sw)}$ is determined directly by solving the equations described below and, in particular, without needing to separately determine $K_{ro}$ or $K_{rw}$.

At 308, a flow rate of oil phase or water phase through the rock in the section is determined. For example, the flow rate can be determined predictively, that is, without needing to measure the flow rate. In sum, this disclosure describes techniques to develop equations that would be trained with measured oil and water flow-rate information and would then be able to predict the oil and water flow information in other rock with similar rock-types either in the current well or in adjacent future wells.

Conventional steady state and unsteady state relative permeability ($K_r$) experiments are carried out on restored cores having limited dimensions and whose initial water saturation and wettability may not be completely representative of in-situ conditions. The techniques described in this disclosure can enable acquiring $K_{rr}$ data at larger scale and at in-situ conditions of initial water saturation and wettability thereby making results more reliable. Steady state Kr experiment on a single core takes more time (for example, about four weeks), whereas $K_{rr}$ acquisition on entire pay interval can be done by implementing the techniques described here in significantly lesser time (for example, within hours). Steady state $K_r$ measurement does not give reliable critical water saturation, while unsteady state $K_r$ experiment do not provide $K_r$ data for all saturations less than the breakthrough saturation. Implementation of the techniques described in this disclosure presents provides a more reliable estimate of critical water saturation and residual oil saturation.

In the following paragraphs, the theoretical bases for implementing the techniques described in this disclosure are presented. In some implementations, the theoretical bases, which includes multiple equations, can be implemented by a computer system, for example, the computer system 500 described with reference to FIG. 5.

The original Darcy's flow equation Eq. 2 was derived for flow of single phase incompressible liquid, particularly the equation was derived for use in the field of hydrology to study the flow of water in the water table.

$$q = \frac{kA\Delta P}{\mu\beta\Delta x} \quad \text{Eq. 2}$$

In Eq. 2, q is the fluid flow rate through porous media having a permeability (k), a cross-sectional area (A), viscosity (μ), formation volume factor (β) across a pressure drop (ΔP) and length (Δx). In hydrocarbon reservoir studies, single phase flow is an idealistic assumption, this is because the drainage process through which oil accumulates in originally water bearing sands does not completely eliminate the connate water. In addition, most reservoirs either experience aquifer support or some sort of fluid injection (for example, gas, water surfactants) for pressure support or improvement of sweep. Therefore a correction term is incorporated into Eq. 3 to account for the reduction in the flow of the main phase in the presence of other phase(s) within the rock pore system. This correction term is referred to as relative permeability.

$$q = \frac{kK_r A\Delta P}{\mu\beta\Delta x} \quad \text{Eq. 3}$$

In general, the equation for radial flow under semi-steady state conditions is given by revised Eq. 3.

$$q = \frac{khK_r\Delta P}{141.2\ \mu\beta\left(\ln\frac{r_e}{r_w} - 0.75\right)} \quad \text{Eq. 3}$$

Relative permeability is measured in the laboratory using the steady state approach or unsteady state approach.

Steady State $K_r$ Measurement

Steady state techniques to measure relative permeability are known. Such techniques allow direct measurement of relative permeability data of core samples under reservoir conditions using live oil or synthetic formulation, for example, brine.

Unsteady State $K_r$ Measurement

In certain known approaches, once the $K_{ro}$ and $K_{rw}$ data have been determined as a function of water saturation $S_w$, the flow of each phase can be independently determined using Eqs. 4 and 5.

$$q_0 = \frac{khK_{ro}\Delta P}{141.2\ \mu_0\beta_0\left(\ln\frac{r_e}{r_w} - 0.75\right)} \quad \text{Eq. 4}$$

$$q_w = \frac{khK_{rw}\Delta P}{141.2\ \mu_w\beta_w\left(\ln\frac{r_e}{r_w} - 0.75\right)} \quad \text{Eq. 5}$$

In the approach described in this disclosure, an expression can be derived for the produced water-oil ratio at in-situ conditions by dividing Eq. 5 with Eq. 4 resulting in Eq. 6.

$$\frac{q_w}{q_o} = \frac{K_{rw}/\mu_w\beta_w}{K_{ro}/\mu_o\beta_o} \quad \text{Eq. 6}$$

An expression for relative permeability ratio can be obtained from Eq. 6 as shown in Eq. 7.

$$K_{rr} = \frac{K_{rw}}{K_{ro}} = \frac{q_w\mu_w\beta_w}{q_o\mu_o\beta_o} \quad \text{Eq. 7}$$

Also an expression for the total liquid rate can be obtained by adding Eq. 4 and Eq. 5 as shown in Eq. 8.

$$q_t = q_o + q_w \frac{kh\Delta P}{141.2\left(\ln\frac{r_e}{r_w} - 0.75\right)}\left[\frac{K_{ro}}{\mu_o\beta_o} + \frac{K_{rw}}{\mu_w\beta_w}\right] \quad \text{Eq. 8}$$

Eq. 8 can be rewritten as Eqs. 9 and 10.

$$q_t = \frac{hk\Delta P}{141.2\left(\ln\frac{r_e}{r_w} - 0.75\right)} M_t \quad \text{Eq. 9}$$

$$\text{where } M_t = \left[\frac{K_{ro}}{\mu_o\beta_o} + \frac{K_{rw}}{\mu_w\beta_w}\right] \quad \text{Eq. 10}$$

Over a moderate range of pressures, $M_t$ can be sufficiently assumed as a sole function of saturation when reservoir fluids are of low compressibility and viscosibility. This condition would be sufficient for flow of liquid phase above bubble point pressure.

When a flow-test is performed on a known interval length of a reservoir at increasing ΔP, then the plot of $q_t$ vs ΔP will yield a slope R from which $M_t$ can be determined as shown in Eq. 11.

$$M_t(S_w) = \frac{141.2\left(\ln\frac{r_e}{r_w} - 0.75\right)R}{kh} \quad \text{Eq. 11}$$

In Eq. 11, h is the flow interval and k is the average interval permeability. From the foregoing equations, phase flow-rates at any saturation can be computed by rearranging Eq. 9 and Eq. 6 as shown in Eqs. 12 and 13.

$$q_t = q_o + q_w = \frac{kh\Delta P}{141.2\left(\ln\frac{r_e}{r_w} - 0.75\right)} M_t \quad \text{Eq. 12}$$

$$\frac{q_w}{q_o} = \frac{\mu_o\beta_o}{\mu_w\beta_w} K_{rr} \quad \text{Eq. 13}$$

Eqs. 12 and 13 can be solved simultaneously for each phase flow-rate to obtain flow rate for the oil phase ($q_o$) and flow rate for the water phase ($q_w$) as shown in Eqs. 14 and 15, respectively.

$$q_0 = \frac{kh\Delta P}{141.2\left(\ln\frac{r_e}{r_w} - 0.75\right)} * \frac{M_{t(sw)}}{\left(1 + \frac{\mu_o\beta_o K_{rr}}{\mu_w\beta_w}\right)} \quad \text{Eq. 14}$$

$$q_w = \frac{q_o\mu_o\beta_o}{\mu_w\beta_w} K_{rr} \quad \text{Eq. 15}$$

Any water saturation interval where the maximum ΔP ($P_i$-$P_b$) produces single phase oil is the operational critical water saturation $S_{wcr*}$ and any water saturation where the maximum ΔP produces single phase water is the operational residual oil saturation $S_{or*}$. In the foregoing equations, $P_i$ is initial reservoir pressure, that is, reservoir pressure at the time of drilling the well. $P_b$ is bubble point pressure, that is, the pressure below which dissolved gas would come out of solution. Because the disclosure assumes an oil water system without gas, the gas dissolved within the oil need not bubble out in the course of the tests. $S_{wcr}$ is critical water saturation which is that threshold water saturation at which water would become mobile in the presence of other fluids(s). This is experimentally determined from the steady and unsteady state experiments. An equivalent value determined based on proposed methodology is $S_{wcr*}$. $S_{or}$ is residual oil saturation, which is the threshold oil saturation that cannot be removed from the pores of the rock by primary and secondary production mechanisms. At $S_{or}$, $K_{ro}$ becomes zero and oil stops to flow (only with the use of tertiary recovery mechanisms like polymer/surfactant flooding can such oil be recovered). The equivalent determined by this proposed approach is $S_{or*}$.

$S_{or*}$ is determined by implementing the techniques described here is more operationally reliable compared to the $S_{or}$ determined from laboratory experiments because $S_{or*}$ is based on the maximum expected displacement pressure rather than the arbitrarily large displacement pressures used in determining $S_{or}$ in the laboratory. $S_{or*}$ provides a more reliable estimate of mobile oil recoverable by primary and secondary recovery mechanisms.

Figure 4:
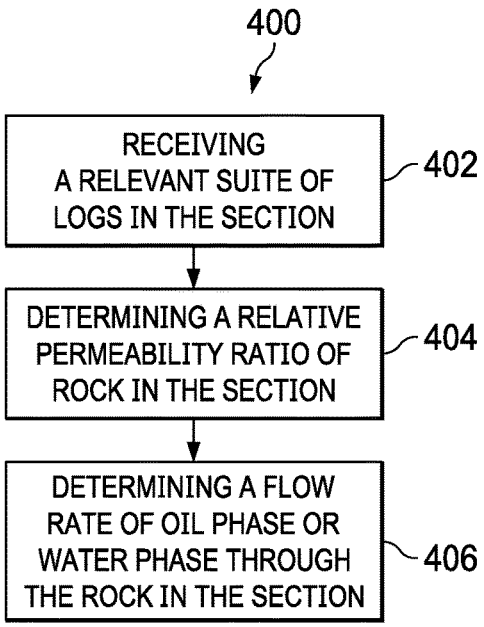
FIG. 4 is a flowchart of an example of a computer-implemented process to predictively determine flow rate of a phase of fluid.

FIG. 4 is a flowchart of an example of a computer-implemented process 400 to predictively determine flow rate of a phase of fluid. The process 400 can be implemented by a computer system, for example, the computer system 500 described with reference to FIG. 5.

At 404, a relevant suite of logs of the rock in the section of the wellbore is received. The relevant suite of logs, for example, the resistivity log 200, can be obtained using techniques described earlier. The relevant suite of logs can be interpreted for water saturation ($S_w$). Zones of constant water saturation (for example, zones 202, 204, 206) are then tested, and the relative amounts of oil and water flow are measured. For example, a drawdown of 100 psi is imposed over a 1 ft interval and the stabilized liquid flow rate is recorded. Then, the drawdown pressure is increased stepwise, for example, to 200 psi, 300 psi, 400 psi, 500 psi up, or by other steps, to a maximum ΔP such that the $P_{wf}=P_b$. $P_{wf}$ is flowing bottom-hole pressure. Fluids flow towards the wellbore because the pressure in the wellbore is less than the pressure in the reservoir. However, in order to ensure that there is no dissolved gas released from the oil, the bottom-hole pressure is kept higher or at most equal to the bubble point pressure $P_b$. The stabilized liquid flow rates (oil and water) are measured in all cases. In particular, the individual flow rates of water and oil (that is, the two phases of the system) are measured. For example, the flow rates and the relative amounts of the two phases can be determined either at the surface or downhole using instrumentation, such as multi-phase meters. Using PVT (pressure, volume, temperature) data of the fluid flowing through the drilled section of the wellbore responsive to the drawdown pressures, the formation volume factors of the two phases and the viscosities of the two phases can be determined.

At 406, a relative permeability ratio of fluids (oil and water) in the rock section is determined. For example, by computationally solving equations described later, the flow data are converted to a plot of relative permeability ratio as a function of average water saturation ($K_{rr(sw)}$) and saturation dependent total mobility ($M_{r(sw)}$). For each drawdown flow period, the computer system 500 solves Eq. 7 to determine $K_{rr}$. This value should be approximately identical for all drawdown pressure values assuming that the fluids have low compressibility and low viscosibility. The computer system 500 can repeat these steps for various log saturation intervals and generate a curve for $K_{rr(sw)}$ versus $S_w$ and $M_{t(sw)}$ versus $S_w$. In this manner, the relative permeability ratio is determined using data obtained from the wellbore drilling and without needing to separately determine $K_{ro}$ or $K_{rw}$.

At 408, a flow rate of oil phase or water phase through the rock in the section is determined. For example, the flow rate can be determined predictively, that is, without needing to measure the flow rate. The computer system 500 can solve Eqs. 14 and 15 to predictively determine phase flow rates at any saturation and for any drawdown pressure.

Figure 5:
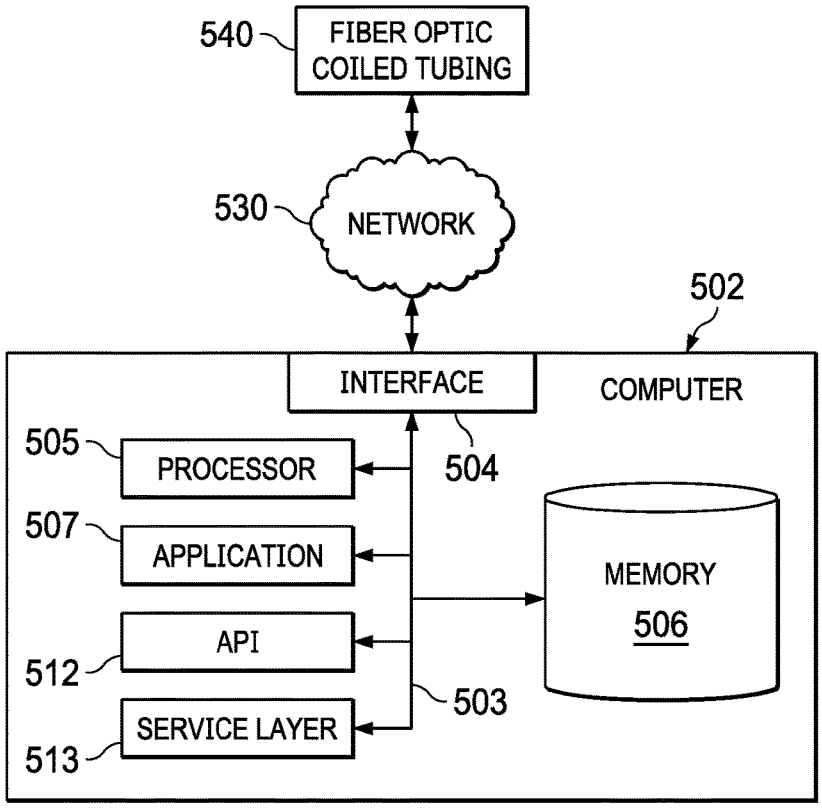
FIG. 5 is a block diagram illustrating an exemplary distributed computer system (EDCS) for performing the workflow from data acquisition to simulation.

FIG. 5 is a block diagram of an exemplary computer system 500 used to provide computational functionalities associated with described algorithms, methods, functions, processes, flows, and procedures as described in the instant disclosure, according to an implementation. The illustrated computer 502 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 502 may comprise a computer that includes an input device, such as a keypad, keyboard, touch screen, or other device that can accept user information, and an output device that conveys information associated with the operation of the computer 502, including digital data, visual, or audio information (or a combination of information), or a GUI.

The computer 502 can serve in a role as a client, network component, a server, a database or other persistency, or any other component (or a combination of roles) of a computer system for performing the subject matter described in the instant disclosure. The illustrated computer 502 is communicably coupled with a network 530. In some implementations, one or more components of the computer 502 may be configured to operate within environments, including cloud-computing-based, local, global, or other environment (or a combination of environments).

At a high level, the computer 502 is an electronic computing device operable to receive, transmit, process, store, or manage data and information associated with the described subject matter. According to some implementations, the computer 502 may also include or be communicably coupled with an application server, e-mail server, web server, caching server, streaming data server, business intelligence (BI) server, or other server (or a combination of servers).

The computer 502 can receive requests over network 530 from a client application (for example, executing on another computer 502) and responding to the received requests by processing the said requests in an appropriate software application. In addition, requests may also be sent to the computer 502 from internal users (for example, from a command console or by other appropriate access method), external or third-parties, other automated applications, as well as any other appropriate entities, individuals, systems, or computers.

Each of the components of the computer 502 can communicate using a system bus 503. In some implementations, any or all of the components of the computer 502, both hardware or software (or a combination of hardware and software), may interface with each other or the interface 504 (or a combination of both) over the system bus 503 using an application programming interface (API) 512 or a service layer 513 (or a combination of the API 512 and service layer 513). The API 512 may include specifications for routines, data structures, and object classes. The API 512 may be either computer-language independent or dependent and refer to a complete interface, a single function, or even a set of APIs. The service layer 513 provides software services to the computer 502 or other components (whether or not illustrated) that are communicably coupled to the computer 502. The functionality of the computer 502 may be accessible for all service consumers using this service layer.

Software services, such as those provided by the service layer 513, provide reusable, defined business functionalities through a defined interface. For example, the interface may be software written in JAVA, C++, or other suitable language providing data in extensible markup language (XML) format or other suitable format. While illustrated as an integrated component of the computer 502, alternative implementations may illustrate the API 512 or the service layer 513 as stand-alone components in relation to other components of the computer 502 or other components (whether or not illustrated) that are communicably coupled to the computer 502. Moreover, any or all parts of the API 512 or the service layer 513 may be implemented as child or sub-modules of another software module, enterprise application, or hardware module without departing from the scope of this disclosure.

The computer 502 includes an interface 504. Although illustrated as a single interface 504 in FIG. 5, two or more interfaces 504 may be used according to particular needs, desires, or particular implementations of the computer 502. The interface 504 is used by the computer 502 for communicating with other systems in a distributed environment that are connected to the network 530 (whether illustrated or not). Generally, the interface 504 comprises logic encoded in software or hardware (or a combination of software and hardware) and operable to communicate with the network 530. More specifically, the interface 504 may comprise software supporting one or more communication protocols associated with communications such that the network 530 or interface's hardware is operable to communicate physical signals within and outside of the illustrated computer 502.

The computer 502 includes a processor 505. Although illustrated as a single processor 505 in FIG. 5, two or more processors may be used according to particular needs, desires, or particular implementations of the computer 502. Generally, the processor 505 executes instructions and manipulates data to perform the operations of the computer 502 and any algorithms, methods, functions, processes, flows, and procedures as described in the instant disclosure.

The computer 502 also includes a memory 506 that holds data for the computer 502 or other components (or a combination of both) that can be connected to the network 530 (whether illustrated or not). For example, memory 506 can be a database storing data consistent with this disclosure. Although illustrated as a single memory 506 in FIG. 5, two or more memories may be used according to particular needs, desires, or particular implementations of the computer 502 and the described functionality. While memory 506 is illustrated as an integral component of the computer 502, in alternative implementations, memory 506 can be external to the computer 502.

The application 507 is an algorithmic software engine providing functionality according to particular needs, desires, or particular implementations of the computer 502, particularly with respect to functionality described in this disclosure. For example, application 507 can serve as one or more components, modules, applications, etc. Further, although illustrated as a single application 507, the application 507 may be implemented as multiple applications 507 on the computer 502. In addition, although illustrated as integral to the computer 502, in alternative implementations, the application 507 can be external to the computer 502.

There may be any number of computers 502 associated with, or external to, a computer system containing computer 502, each computer 502 communicating over network 530. Further, the term "client," "user," and other appropriate terminology may be used interchangeably as appropriate without departing from the scope of this disclosure. Moreover, this disclosure contemplates that many users may use one computer 502, or that one user may use multiple computers 502.

Example

Figures 8, 9:
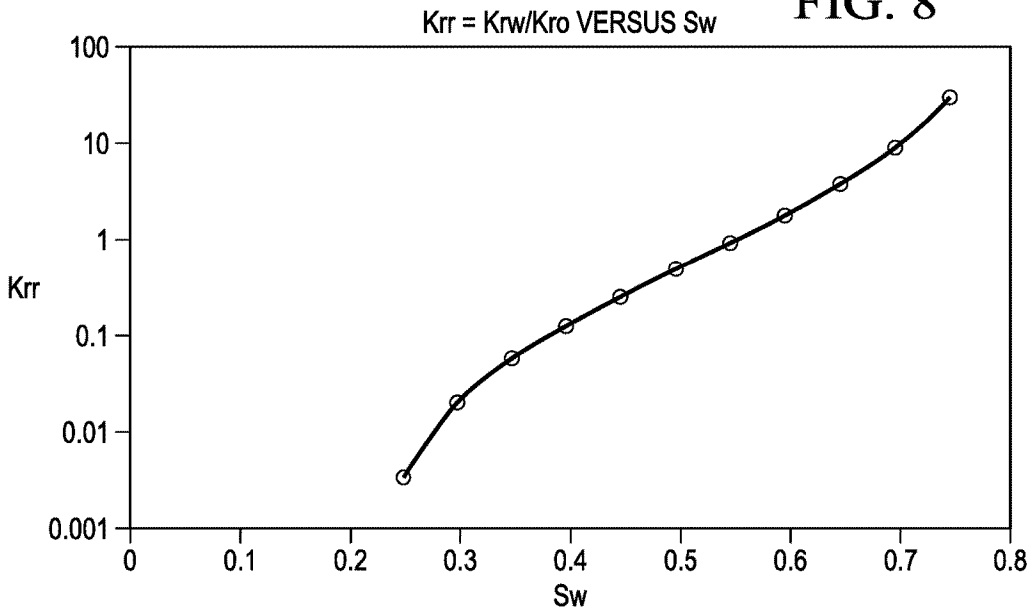
FIG. 8 is a plot showing relative permeability ratio versus water saturation for the data shown in the tables of FIGS. 6 and 7.
FIG. 9 is a table showing multi-rate flow test results at each saturation.
Figure 10:
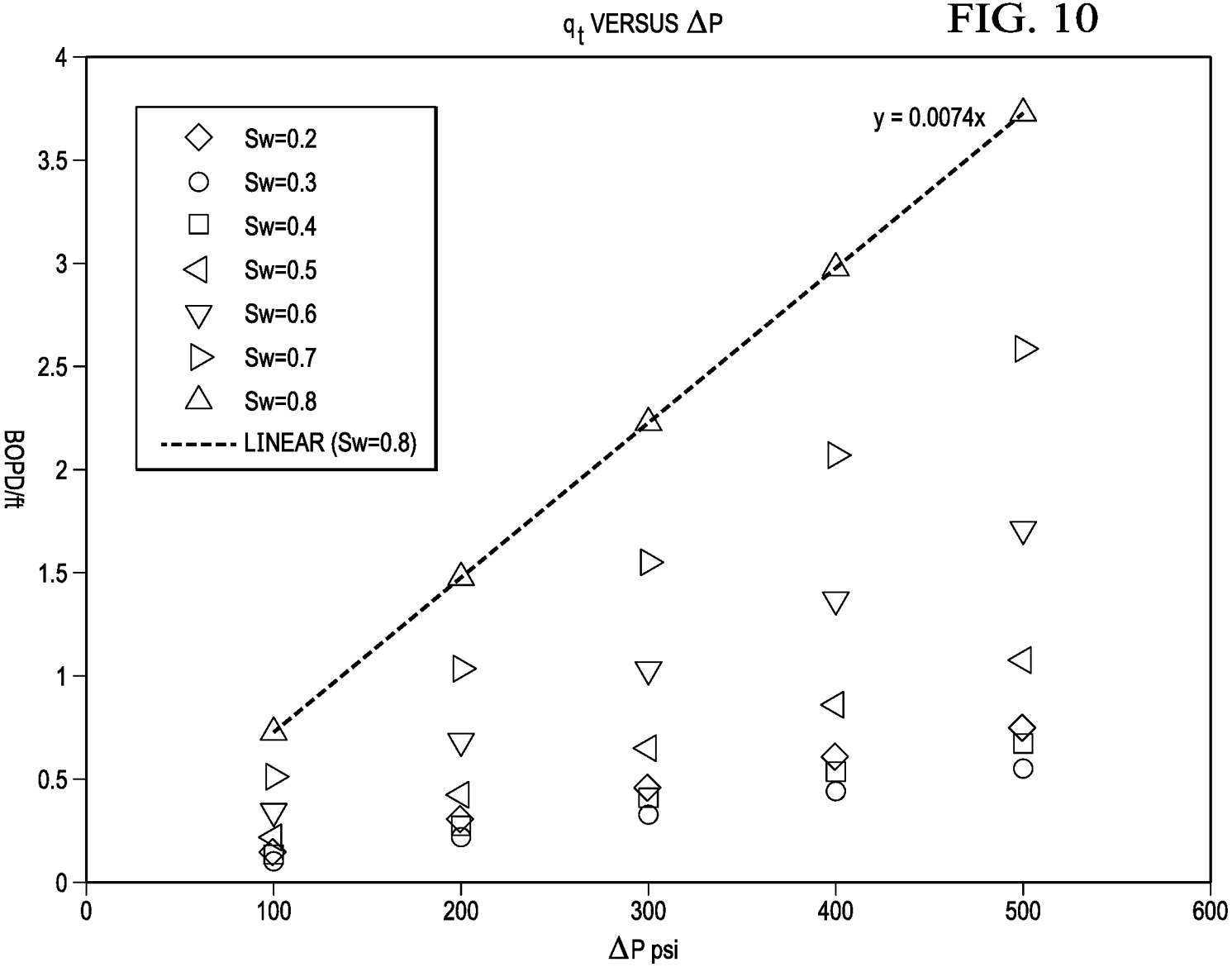
FIG. 10 is a plot of total fluid rate versus drawdown pressure at each saturation.

FIG. 6 is a table showing an open source experimental Kr data and corresponding rock and fluid properties were used to generate measured oil and water rates at various saturations. Using Eq. 4 and Eq. 5, individual phase flow-rates were computed and total flow-rate calculate from the sum. Pressure draw-down of 500 psi was assumed, permeability of 10 md, flow-interval of 1 ft, oil viscosity of 5 cp, water viscosity of 0.5 cp, $\beta_0$ of 1.3 and $\beta_w$ of 1.0. $B_0$ is the formation volume factor for oil. $\beta_w$ is the formation volume factor for water. Formation volume factor of a phase represents a quantity by which the reservoir volume of the fluid will shrink when brought to surface conditions of temperature and pressure. Formation volume factor (oil, water) FIG. 7 is a table summarizing computed flow rates used to represent actual measured flow rates. FIG. 8 is a plot showing relative permeability ratio versus water saturation for the data shown in the tables of FIGS. 6 and 7. FIG. 9 is a table showing multi-rate flow test results at each saturation. FIG. 10 is a plot of total fluid rate versus drawdown pressure at each saturation. FIG. 11 is a plot of total mobility versus water saturation. FIG. 12 is a table showing flow rates predictively determined from the total mobility and relative permeability ratio. FIG. 13 is a plot showing the correlation between calculated rate and measured rate that shows that the equations developed are able to effectively back-predict measured rates.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Implementations of the subject matter described in this specification can be implemented as one or more computer programs, that is, one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal, for example, a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The term "real-time," "real time," "realtime," "real (fast) time (RFT)," "near(ly) real-time (NRT)," "quasi real-time," or similar terms (as understood by one of ordinary skill in the art), means that an action and a response are temporally proximate such that an individual perceives the action and the response occurring substantially simultaneously. For example, the time difference for a response to display (or for an initiation of a display) of data following the individual's action to access the data may be less than 1 ms, less than 1 sec., less than 5 secs., etc. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

The terms "data processing apparatus," "computer," or "electronic computer device" (or equivalent as understood by one of ordinary skill in the art) refer to data processing hardware and encompass all kinds of apparatus, devices, and machines for processing data, including by way of example, a programmable processor, a computer, or multiple processors or computers. The apparatus can also be or further include special purpose logic circuitry, for example, a central processing unit (CPU), an FPGA (field programmable gate array), or an ASIC (application-specific integrated circuit). In some implementations, the data processing apparatus or special purpose logic circuitry (or a combination of the data processing apparatus or special purpose logic circuitry) may be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, IOS, or any other suitable conventional operating system.

A computer program, which may also be referred to or described as a program, software, a software application, a module, a software module, a script, or code can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network. While portions of the programs illustrated in the various figures are shown as individual modules that implement the various features and functionality through various objects, methods, or other processes, the programs may instead include a number of sub-modules, third-party services, components, libraries, and such, as appropriate. Conversely, the features and functionality of various components can be combined into single components as appropriate. Thresholds used to make computational determinations can be statically, dynamically, or both statically and dynamically determined.

The methods, processes, logic flows, etc. described in this specification can be performed by one or more programmable computers executing one or more computer programs to perform functions by operating on input data and generating output. The methods, processes, logic flows, etc. can also be performed by, and apparatus can also be implemented as, special purpose logic circuitry, for example, a CPU, an FPGA, or an ASIC.

Computers suitable for the execution of a computer program can be based on general or special purpose microprocessors, both, or any other kind of CPU. Generally, a CPU will receive instructions and data from a read-only memory (ROM) or a random access memory (RAM), or both. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable storage device, for example, a universal serial bus (USB) flash drive, to name just a few.

Computer-readable media (transitory or non-transitory, as appropriate) suitable for storing computer program instructions and data include all forms of non-volatile memory, media and memory devices, including by way of example semiconductor memory devices, for example, erasable programmable read-only memory (EPROM), electrically erasable programmable read-only memory (EEPROM), and flash memory devices; magnetic disks, for example, internal hard disks or removable disks; magneto-optical disks; and CD-ROM, DVD+/−R, DVD-RAM, and DVD-ROM disks. The memory may store various objects or data, including caches, classes, frameworks, applications, backup data, jobs, web pages, web page templates, database tables, repositories storing dynamic information, and any other appropriate information including any parameters, variables, algorithms, instructions, rules, constraints, or references thereto. Additionally, the memory may include any other appropriate data, such as logs, policies, security or access data, reporting files, as well as others. The processor and the memory can be supplemented by, or incorporated in, special purpose logic circuitry.

To provide for interaction with a user, implementations of the subject matter described in this specification can be implemented on a computer having a display device, for example, a CRT (cathode ray tube), LCD (liquid crystal display), LED (Light Emitting Diode), or plasma monitor, for displaying information to the user and a keyboard and a pointing device, for example, a mouse, trackball, or trackpad by which the user can provide input to the computer. Input may also be provided to the computer using a touchscreen, such as a tablet computer surface with pressure sensitivity, a multi-touch screen using capacitive or electric sensing, or other type of touchscreen. Other kinds of devices can be used to provide for interaction with a user as well; for example, feedback provided to the user can be any form of sensory feedback, for example, visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

The term "graphical user interface," or "GUI," may be used in the singular or the plural to describe one or more graphical user interfaces and each of the displays of a particular graphical user interface. Therefore, a GUI may represent any graphical user interface, including but not limited to, a web browser, a touch screen, or a command line interface (CLI) that processes information and efficiently presents the information results to the user. In general, a GUI may include a plurality of user interface (UI) elements, some or all associated with a web browser, such as interactive fields, pull-down lists, and buttons. These and other UI elements may be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with this disclosure), all or a portion of the Internet, or any other communication system or systems at one or more locations (or a combination of communication networks). The network may communicate with, for example, Internet Protocol (IP) packets, Frame Relay frames, Asynchronous Transfer Mode (ATM) cells, voice, video, data, or other suitable information (or a combination of communication types) between network addresses.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of any invention or on the scope of what may be claimed, but rather as descriptions of features that may be specific to particular implementations of particular inventions. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although features may be described above as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the implementations described above should not be understood as requiring such separation or integration in all implementations, and it should be understood that the described program components and systems can generally be integrated together in a single software product or packaged into multiple software products.

Accordingly, the above description of example implementations does not define or constrain this disclosure. Other changes, substitutions, and alterations are also possible without departing from the spirit and scope of this disclosure.

Furthermore, any claimed implementation below is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A method comprising:

drilling a section of a wellbore in a subterranean zone including a subsurface reservoir in which hydrocarbons are entrapped, the hydrocarbons comprising a multiphase fluid comprising oil phase and water phase;

defining an oil-water rock system in the section of the wellbore without a gaseous phase;

obtaining a suite of logs of rock in the section of the wellbore using a logging equipment, wherein the suit of logs comprising a resistivity log and a density log of the rock;

determining water saturation from the resistivity log and the density log of the suite of logs of the rock;

determining a relative permeability ratio of the rock in the section, the relative permeability ratio being a ratio of the relative permeability of water to the relative permeability of oil without separately determining a relative permeability ratio of water and a relative permeability ratio of oil;

determine, using the relative permeability ratio, a flow rate of the oil phase or a flow rate of the water phase through the rock; and drilling and producing the wellbore based on the determined flow rate of the oil phase or the flow rate of the water phase through the rock.

2. The method of claim 1, determining the relative permeability ratio comprises:

measuring a flow rate of the oil phase through the section of the wellbore;

measuring a flow rate of the water phase through the section of the wellbore; and determining a formation volume factor and a viscosity for each of the oil phase and the water phase from pressure, volume and temperature of the oil phase and the water phase.

3. The method of claim 1, wherein determining the relative permeability ratio comprises:

imposing a drawdown pressure over a pre-determined depth interval through the section of the wellbore; and recording a stabilized well fluid flow rate through the section of the wellbore at the drawdown pressure over the pre-determined depth interval.

4. The method of claim 3, wherein the drawdown pressure is a first drawdown pressure, and wherein determining the relative permeability ratio comprises:

imposing a plurality of drawdown pressures, each greater than the first drawdown pressure, over the pre-determined depth interval through the section of the wellbore; and for each of the plurality of drawdown pressures, recording a respective stabilized well fluid flow rate through the section of the wellbore at the drawdown pressure over the pre-determined depth interval.

5. The method of claim 4, further comprising generating a plot of the relative permeability ratio versus water saturation and a second plot of a total mobility versus water saturation for the plurality of drawdown pressures and the first drawdown pressure.

6. The method of claim 1, wherein determining the relative permeability ratio comprises determining a water saturation ($S_W$) and then determining a total mobility ($M_t$ ($_{sw}$)) of the liquid phase through the rock in the section using equation $$M_t(S_w) = \frac{141.2\left(\ln\frac{r_e}{r_w} - 0.75\right)R}{kh}$$

where R is determined from the slope of a plot defined as the flow rate versus a change in pressure for the corresponding water saturation, h is the flow interval, and k is the average interval permeability.

7. A computer-implemented method comprising:

drilling a section of a wellbore in a subterranean zone including a subsurface reservoir in which hydrocarbons are entrapped, the hydrocarbons comprising a multi-phase fluid comprising oil phase and water phase;

defining an oil-water rock system in the section of the wellbore without gaseous phase;

obtaining a suite of logs of rock in the section of the wellbore using a logging equipment, wherein the suite of logs comprises a resistivity log and a density log of the rock;

determining, by the computing environment comprising one or more computers, a relative permeability ratio of the rock in the section, the relative permeability ratio being a ratio of the relative permeability of water to the relative permeability of oil without separately determining a relative permeability ratio foe water and a relative permeability ratio of oil;

determine, by the computing environment comprising one or more computers and using the relative permeability ratio, a flow rate of the oil phase or a flow rate of the water phase through the rock in the section of the wellbore; and drilling and producing the wellbore based on the determined flow rate of the oil phase or the flow rate of the water phase through the rock in the section of the wellbore.

8. The method of claim 7, determining the relative permeability ratio comprises:

measuring a flow rate of the oil phase through the section of the wellbore;

measuring a flow rate of the water phase through the section of the wellbore; and determining a formation volume factor and a viscosity for each of the oil phase and the water phase from pressure, volume and temperature of the oil phase and the water phase.

9. The method of claim 7, wherein determining the relative permeability ratio comprises:

imposing a drawdown pressure over a pre-determined depth interval through the section of the wellbore; and recording a stabilized well fluid flow rate through the section of the wellbore at the drawdown pressure over the pre-determined depth interval.

10. The method of claim 9, wherein the drawdown pressure is a first drawdown pressure, and wherein determining the relative permeability ratio comprises:

imposing a plurality of drawdown pressures, each greater than the first drawdown pressure, over the pre-determined depth interval through the section of the wellbore; and for each of the plurality of drawdown pressures, recording a respective stabilized well fluid flow rate through the section of the wellbore at the drawdown pressure over the pre-determined depth interval.

11. The method of claim 10, further comprising generating a plot of the relative permeability ratio versus water saturation and a second plot of a total mobility versus water saturation for the plurality of drawdown pressures and the first drawdown pressure.

12. The method of claim 7, wherein determining the relative permeability ratio comprises determining a water saturation and a total mobility of the liquid phase through the rock in the section using the relative permeability of the water.

13. A computer-readable medium storing instructions executable by one or more processors to perform operations comprising:

drilling a section of a wellbore in a subterranean zone including a subsurface reservoir in which hydrocarbons are entrapped, the hydrocarbons comprising a multi-phase fluid comprising oil phase and water phase;

defining an oil-water rock system in the section of the wellbore without gaseous phase;

obtaining a suite of logs of rock in the section of the wellbore using a logging equipment, wherein the suite of logs comprises a resistivity log and a density log of the rock;

determining a relative permeability ratio of the rock in the section, the relative permeability ratio being a ratio of the relative permeability of water to the relative permeability of oil without separately determining a relative permeability ratio of water and a relative permeability ratio of oil;

determine, using the relative permeability ratio, a flow rate of the oil phase or a flow rate of the water phase through the rock in the section of the wellbore; and drilling and producing the wellbore based on the determined flow rate of the oil phase or the flow rate of the water phase through the rock in the section of the wellbore.

14. The medium of claim 13, determining the relative permeability ratio comprises:

measuring a flow rate of the oil phase through the section of the wellbore;

measuring a flow rate of the water phase through the section of the wellbore; and determining a formation volume factor and a viscosity for each of the oil phase and the water phase from pressure, volume and temperature of the oil phase and the water phase.

15. The medium of claim 13, wherein determining the relative permeability ratio comprises:

imposing a drawdown pressure over a pre-determined depth interval through the section of the wellbore; and recording a stabilized well fluid flow rate through the section of the wellbore at the drawdown pressure over the pre-determined depth interval.

16. The medium of claim 15, wherein the drawdown pressure is a first drawdown pressure, and wherein determining the relative permeability ratio comprises:

imposing a plurality of drawdown pressures, each greater than the first drawdown pressure, over the pre-determined depth interval through the section of the wellbore; and for each of the plurality of drawdown pressures, recording a respective stabilized well fluid flow rate through the section of the wellbore at the drawdown pressure over the pre-determined depth interval.

17. The medium of claim 13, wherein determining the relative permeability ratio comprises determining a water saturation and a total mobility of the liquid phase through the rock in the section using the relative permeability of the water.

18. A system comprising:

a computing environment comprising one or more computers; and a computer-readable medium storing instructions executable by the computing environment to perform operations comprising:

drilling a section of a wellbore in a subterranean zone including a subsurface reservoir in which hydrocarbons are entrapped, the hydrocarbons comprising a multiphase fluid comprising oil phase and water phase;

defining an oil-water rock system in the section of the wellbore without gaseous phase;

obtaining a suite of logs of rock in the section of the wellbore using a logging equipment, wherein the suite of logs comprises a resistivity log and a density log of the rock;

determining a relative permeability ratio of the rock in the section, the relative permeability ratio being a ratio of the relative permeability of water to the relative permeability of oil without separately determining a relative permeability ratio of water and a relative permeability ratio of oil;

determine, using the relative permeability ratio, a flow rate of the oil phase or a flow rate of the water phase through the rock in the section of the wellbore; and drilling and producing the wellbore based on the determined flow rate of the oil phase or the flow rate of the water phase through the rock in the section of the wellbore.

19. The system of claim 18, determining the relative permeability ratio comprises:

measuring a flow rate of the oil phase through the section of the wellbore;

measuring a flow rate of the water phase through the section of the wellbore; and determining a formation volume factor and a viscosity for each of the oil phase and the water phase from pressure, volume and temperature of the oil phase and the water phase.

20. The system of claim 18, wherein determining the relative permeability ratio comprises:

imposing a drawdown pressure over a pre-determined depth interval through the section of the wellbore; and recording a stabilized well fluid flow rate through the section of the wellbore at the drawdown pressure over the pre-determined depth interval.

21. The system of claim 20, wherein the drawdown pressure is a first drawdown pressure, and wherein determining the relative permeability ratio comprises:

imposing a plurality of drawdown pressures, each greater than the first drawdown pressure, over the pre-determined depth interval through the section of the wellbore; and for each of the plurality of drawdown pressures, recording a respective stabilized well fluid flow rate through the section of the wellbore at the drawdown pressure over the pre-determined depth interval.

22. The system of claim 21, the operations further comprising generating a plot of the relative permeability ratio versus water saturation and a second plot of a total mobility versus water saturation for the plurality of drawdown pressures and the first drawdown pressure.

23. The system of claim 18, wherein determining the relative permeability ratio comprises determining a water saturation and a total mobility of the water phase through the rock in the section using the relative permeability of the water.

24. A wellbore system comprising:

a drilling system configured to drill a section of a wellbore in a subterranean zone including a subsurface reservoir in which hydrocarbons are entrapped, the hydrocarbons comprising a multiphase fluid comprising oil phase and water phase; and a wellbore computer system connected to the drilling system, the wellbore computer system comprising: a computing environment comprising one or more computers; and a computer-readable medium storing instructions executable by the computing environment to perform operations comprising:

defining an oil-water rock system in the section of the wellbore without gaseous phase;

obtain a suite of logs of rock in the section of the wellbore using a logging equipment;

determining water saturation from the suite of logs;

determining a relative permeability ratio of the rock in the section, the relative permeability ratio being a ratio of the relative permeability of water to the relative permeability of oil without separately determining a relative permeability ratio of water and a relative permeability ratio of oil;

determine, using the relative permeability ratio, a flow rate of the oil phase or a flow rate of the water phase through the rock in the section of the wellbore; and drilling and producing the wellbore based on the determined flow rate of the oil phase or the flow rate of the water phase through the rock in the section of the wellbore.

25. The wellbore system of claim 24, determining the relative permeability ratio comprises:

measuring a flow rate of the oil phase through the section of the wellbore;

measuring a flow rate of the water phase through the section of the wellbore; and determining a formation volume factor and a viscosity for each of the oil phase and the water phase from pressure, volume and temperature of the oil phase and the water phase.

26. The wellbore system of claim 24, wherein determining the relative permeability ratio comprises:

imposing a drawdown pressure over a pre-determined depth interval through the section of the wellbore; and recording a stabilized well fluid flow rate through the section of the wellbore at the drawdown pressure over the pre-determined depth interval.

27. The wellbore system of claim 26, wherein the drawdown pressure is a first drawdown pressure, and wherein determining the relative permeability ratio comprises:

imposing a plurality of drawdown pressures, each greater than the first drawdown pressure, over the pre-determined depth interval through the section of the wellbore; and for each of the plurality of drawdown pressures, recording a respective stabilized well fluid flow rate through the section of the wellbore at the drawdown pressure over the pre-determined depth interval.

28. The wellbore system of claim 27, the operations further comprising generating a plot of the relative permeability ratio versus water saturation and a second plot of a total mobility versus water saturation for the plurality of drawdown pressures and the first drawdown pressure.

29. The wellbore system of claim 24, wherein determining the relative permeability ratio comprises determining a water saturation and a total mobility of the water phase through the rock in the section using the relative permeability of the water.

* * * * *